US006839031B2

(12) United States Patent
Downs

(10) Patent No.: US 6,839,031 B2
(45) Date of Patent: Jan. 4, 2005

(54) WIRELESS LOOP ANTENNA BATTERY SAVER

(75) Inventor: Stuart G. Downs, San Diego, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 43 days.

(21) Appl. No.: 10/146,148

(22) Filed: May 15, 2002

(65) Prior Publication Data

US 2003/0214453 A1 Nov. 20, 2003

(51) Int. Cl.[7] ..... H01Q 1/24

(52) U.S. Cl. ..... 343/702; 343/742; 343/867; 455/277.1

(58) Field of Search ..... 343/700 MS, 702, 343/741, 742, 866, 867, 725, 754, 757; 455/277.1; 342/359

(56) References Cited

U.S. PATENT DOCUMENTS 3,906,506 A * 9/1975 Verma et al. ..... 343/702
3,940,767 A * 2/1976 DeLano et al. ..... 342/63
4,280,128 A * 7/1981 Masak ..... 342/380
4,342,999 A * 8/1982 Woodward et al. ..... 343/702
4,540,988 A * 9/1985 Munk et al. ..... 343/728
5,898,908 A * 4/1999 Griffin et al. ..... 455/127.2
6,111,542 A * 8/2000 Day et al. ..... 342/359
2002/0083458 A1 * 6/2002 Henderson et al. ..... 725/72

* cited by examiner

*Primary Examiner*—Tan Ho
(74) *Attorney, Agent, or Firm*—Tarolli, Sundheim, Covell & Tummino L.L.P.

(57) ABSTRACT

A wireless telephone antenna system including at least one loop antenna (12) providing a directional antenna field pattern with superior gain performance in comparison to an omnidirectional antenna. The antenna system effectively rotates the loop antenna and selects the best gain in a direction of interest. The antenna system preferably also includes a conventional omnidirectional antenna (18), to which radio-frequency (RF) power is reduced when a better antenna gain is provided by the loop antenna, thereby reducing overall power consumption of the telephone. The loop antenna field pattern (14) is preferably selected to minimize RF radiation in the direction of the user's head (40).

8 Claims, 1 Drawing Sheet

WIRELESS LOOP ANTENNA BATTERY SAVER

BACKGROUND OF THE INVENTION

The present invention relates generally to antennas and, more particularly, to antennas for hand-held cellular or wireless telephones. Cellular telephone antennas are typically vertically polarized omnidirectional antennas. Since no vertically polarized axis has any gain advantage in any particular direction, the antenna radiates equally well in all directions. A graphical representation of field strength resulting from a vertically polarized omnidirectional antenna is a well known "donut" pattern. Since the directional location of the nearest receiving station is not usually known to a user of a cellular telephone, omnidirectionality has long been considered to be a requirement for cellular telephone antenna design. Clearly, however, an omnidirectional antenna is not energy efficient because a large proportion of the radiated energy is not directed toward a desired receiver antenna. Another disadvantage of omnidirectional antennas on hand-held transmitters is that the user, and in particular the user's head, is exposed to significant levels of radiated radio-frequency (RF) energy.

From an energy efficiency and user safety standpoint, it would be much more desirable to provide a hand-held cellular telephone with a radiated beam pattern that is always shaped and directed to provide a desired signal strength at a receiver station, while at the same time minimizing user exposure to the radiation. The present invention is directed to this end.

BRIEF SUMMARY OF THE INVENTION

The present invention resides in the use of a loop antenna in a wireless telephone, to provide an antenna lobe pattern that exhibits higher gain in a selected direction than the gain of a conventional omnidirectional antenna. Briefly, the device of the invention is a wireless telephone antenna system, comprising at least one loop antenna; and means for steering the at least one loop antenna automatically to provide maximum antenna gain in a desired direction. In a disclosed embodiment of the invention, the antenna system includes at least two loop antennas, and the means for steering the loop antenna includes a plurality of antenna feed switches, operable to select a loop antenna that provides the best gain in the desired direction. Ideally, the antenna system further comprises an omnidirectional antenna, for use in conjunction with the loop antennas; and means for coupling radio-frequency (RF) power to one or both of the omnidirectional antenna and the selected loop antenna, based on their relative performance at any given time.

More specifically, the antenna system comprises means for selecting between the omnidirectional antenna and the at least one loop antenna, based on their relative gain in the desired direction. In a disclosed embodiment of the invention, the omnidirectional antenna takes the form of a conductive sleeve surrounding the at least one loop antenna.

The invention may also be defined as a method of optimizing antenna performance in a wireless telephone having both an omnidirectional antenna and a loop antenna. Briefly, the method comprises the steps of enabling a loop antenna in a wireless telephone; rotating the field pattern associated with the loop antenna to optimize gain performance in a desired azimuth direction; and if loop antenna gain performance in the desired azimuth direction exceeds omnidirectional antenna gain performance, decreasing radio-frequency (RF) power supplied to and received from the omnidirectional antenna, to optimize overall performance.

As disclosed in this specification, the step of rotating the field pattern associated with the loop antenna includes switching among multiple loop antennas oriented at different selected azimuth angles. Ideally, the step of rotating the field pattern includes limiting the selected azimuth angles to provide for all selections an effective null in the field pattern at angular locations that minimize radiation toward a user of the telephone.

It will be appreciated from the foregoing that the present invention provides a significant advantage over antenna systems of the prior art used for wireless telephones. In particular, the invention provides an improvement in antenna gain over conventional omnidirectional antennas, and provides a radiation pattern that can be conveniently oriented to minimize radio-frequency (RF) exposure to a user's head. Other aspects and advantages of the invention will become apparent from the following more detailed description, taken in conjunction with the accompanying drawings.

DETAILED DESCRIPTION OF THE INVENTION

Figure 1:
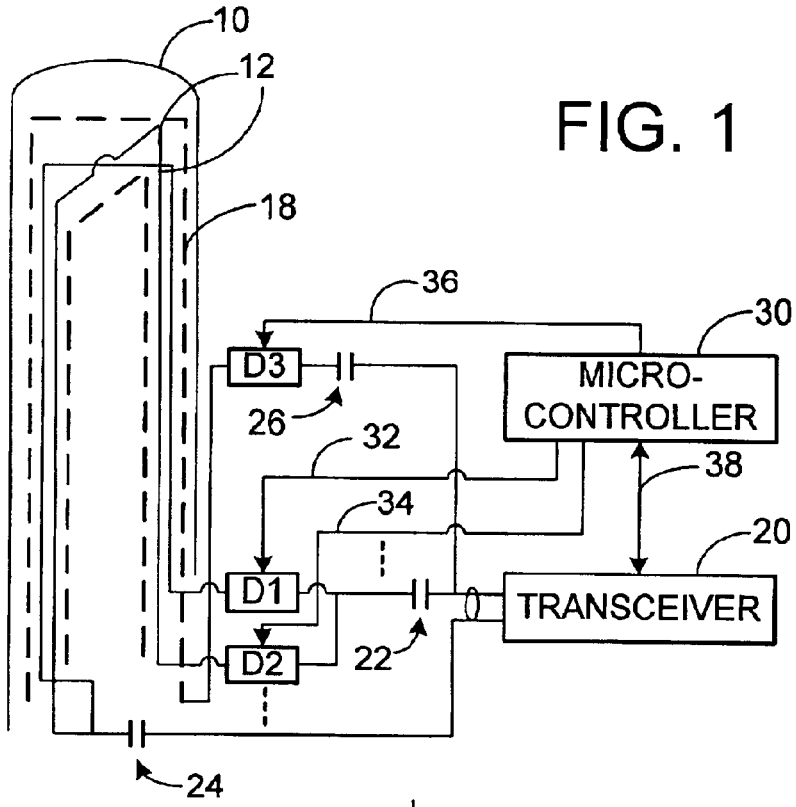
FIG. 1 is a diagrammatic view of a cellular telephone antenna system in accordance with the present invention.

As shown in the drawings for purposes of illustration, the present invention pertains to the use of a directional loop antenna in a hand-held cellular or wireless telephone. Conventional wireless telephone antennas are vertically polarized and omnidirectional. Consequently they are not energy efficient and may pose a potential health threat to users.

In accordance with the invention, a hand-held cellular telephone, a portion of which is indicated by reference numeral 10 (FIG. 1), is provided with at least one directional loop antenna, two of which are indicated at 12. Each loop antenna 12 has multiple turns of a conductive wire in a generally vertical plane (if the telephone is held in a generally vertical orientation). Each loop antenna 12 has a lobe pattern of field strength similar to that shown in FIG. 2, i.e., it has two diametrically opposed lobes 14 extending horizontally from the telephone 10. It is known in the art of antenna design that a loop antenna of this type will provide a higher gain in the lobe directions than a conventional omnidirectional vertically polarized antenna. Therefore, if the loop antenna can be positioned such that one of its lobes is directed toward a telephone base station (not shown), the telephone 10 may be operated more efficiently, since a higher antenna gain results in lower power drain from the telephone battery power supply for a given level of transmission performance.

In accordance with another aspect of the invention, the telephone 10 includes two or more of the loop antennas 12. As indicated in FIG. 1, each of the loop antennas 12 is oriented at a different angular (azimuth) position with respect to a common vertical axis. Thus, switching from one loop antenna 12 to another provides a steering or rotation of the loop antenna system, as indicated in the lobe pattern by the arrows 16.

In accordance with another aspect of the invention, the antenna system of the invention further includes at least one conventional vertically polarized antenna, referred to herein as a vertical antenna. As indicated in FIG. 1, the vertical antenna 18 may take the form of a metallic tube in which one of the loop antennas 12 is housed. As discussed above, this vertical antenna 18 has an omnidirectional field pattern but provides less gain than the maximum gain of a loop antenna.

As shown in FIG. 1, one terminal of each of the loop antennas 12 is connected to a transceiver 20 through which communication signals are transmitted to and received from a selected antenna. Each antenna 12 is connected to the transceiver 20 through a switching diode, such as the diodes D1 and D2, which may be conventional PIN diodes, and then in common through a matching capacitor 22 to the transceiver. Second terminals of the loop antennas 12 are connected in common through a loop resonating capacitor 24 and thence to a second input of the transceiver 20. The vertical antenna 18 is similarly coupled to the transceiver 20, through its separate PIN diode D3 and matching capacitor 26.

A microcontroller 30 has output control lines 32, 34 and 36 connected to diodes D1, D2 and D3, respectively, and communicates with the transceiver 20 over bidirectional lines, indicated at 38. Software in the microcontroller 30 switches among the available loop antennas 12, effectively rotating the loop antenna lobe pattern to locate the best gain advantage over the vertical antenna 18. If a gain advantage is found, the microcontroller 30 reduces RF (radio-frequency) power supplied to the vertical antenna 18. At this point, the telephone 10 draws less power than if the vertical antenna 18 alone were used, because of the higher antenna gains provided by the loop antennas 12. If for some reason the loop antennas 12 do not provide a gain advantage over the vertical antenna 18, the latter can still be used in conventional fashion. Overall, however, availability of the loop antennas 12 results in a lower average power consumption by the antenna system.

Figure 2:
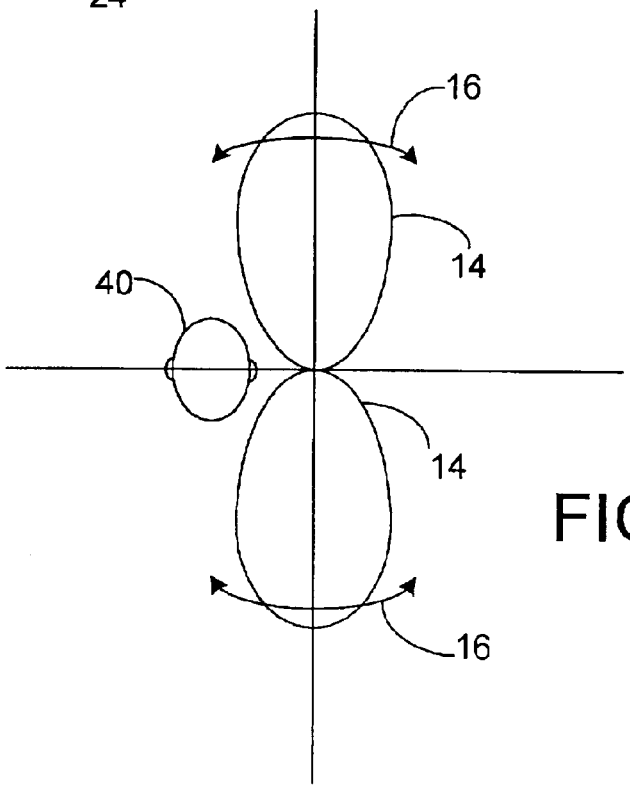
FIG. 2 is a graph showing the lobe pattern of the antenna of the invention.

Another significant advantage of the use of the loop antennas 12 is the presence of inherent nulls in their field pattern, as depicted in FIG. 2. The available loop antenna orientations can be arranged such that one of these nulls is positioned in the same location as the telephone user's head, indicated at 40 in FIG. 2. Although no clear linkage has yet been made between wireless telephone usage and user injury, minimization of RF exposure is always a desirable goal in wireless telephone design.

It will be appreciated from the foregoing that the present invention provides a significant advantage over conventional omnidirectional antennas for wireless telephones. In particular, the availability of a steerable loop antenna provides increased antenna gain, and therefore lower battery power consumption for equivalent transmission quality. Further, the use of a loop antenna minimizes RF radiation into the user's head. It will be understood that, although a specific embodiment of the invention has been described by way of example, various modifications may be made without departing from the spirit and scope of the invention. For example, although an electronically steerable loop antenna has been described, the principles of the invention also apply to a single loop antenna steered electromechanically. In brief, the invention should not be limited except as by the appended claims.

What is claimed is:

1. A wireless telephone antenna system, comprising:

a first antenna;

a second antenna; and means for automatically selecting between the first antenna and the second antenna to provide maximum antenna gain in a desired direction.

2. A wireless telephone antenna system as defined in claim 1, wherein:

the first antenna comprising a first loop antenna and the second antenna comprising a second loop antenna, the first loop antenna and the second loop antenna being oriented at different angular positions with respect to a common axis; and the means for automatically selecting between the first antenna and the second antenna includes a plurality of antenna feed switches, for selecting a loop antenna that provides the best gain in the desired direction.

3. A wireless telephone antenna system as defined in claim 2, and further comprising:

an omnidirectional antenna; and means for coupling radio-frequency (RF) power to one or both of the omnidirectional antenna and the selected loop antenna, based on their relative performance at any given time.

4. A wireless telephone antenna system as defined in claim 1, the first antenna comprising an omnidirectional antenna, and the second antenna comprising a loop antenna.

5. A wireless telephone antenna system as defined in claim 4, wherein the omnidirectional antenna takes the form of a conductive sleeve surrounding the loop antenna.

6. A method of optimizing antenna performance in a wireless telephone having both an omnidirectional antenna and a loop antenna, the method comprising the steps of:

enabling the loop antenna in the wireless telephone;

rotating the field pattern associated with the loop antenna to optimize gain performance in a desired azimuth direction; and if loop antenna gain performance in the desired azimuth direction exceeds omnidirectional antenna gain performance, decreasing radio-frequency (RF) power supplied to and received from the omnidirectional antenna to optimize overall performance.

7. A method as defined in claim 6, wherein the step of rotating the field pattern associated with the loop antenna includes switching among multiple loop antennas oriented at different selected azimuth angles.

8. A method as defined in claim 6, wherein the step of rotating the field pattern includes limiting the selected azimuth angles to provide for all selections an effective null in the field pattern at angular locations that minimize radiation toward a user of the telephone.

* * * * *